US010245498B2

(12) United States Patent
Dueck et al.

(10) Patent No.: US 10,245,498 B2
(45) Date of Patent: Apr. 2, 2019

(54) LIGHTWEIGHT BALL GLOVE

(71) Applicants: Brian Mathew Dueck, Aptos, CA (US); Corey D Schaefer, Aptos, CA (US); Kevin B Dueck, Aptos, CA (US)

(72) Inventors: Brian Mathew Dueck, Aptos, CA (US); Corey D Schaefer, Aptos, CA (US); Kevin B Dueck, Aptos, CA (US)

( * ) Notice: Subject to any disclaimer, the term of this patent is extended or adjusted under 35 U.S.C. 154(b) by 8 days.

(21) Appl. No.: 15/269,039

(22) Filed: Sep. 19, 2016

(65) Prior Publication Data

US 2018/0078842 A1 Mar. 22, 2018

(51) Int. Cl.

| | |
|---|---|
| ***A63B 71/14*** | (2006.01) |
| ***A41D 19/015*** | (2006.01) |
| ***A41D 19/00*** | (2006.01) |
| *A63B 102/18* | (2015.01) |

(52) U.S. Cl.

CPC ..... *A63B 71/143* (2013.01); *A41D 19/0006* (2013.01); *A41D 19/0048* (2013.01); *A41D 19/01523* (2013.01); *A41D 19/01582* (2013.01); *A41D 2300/52* (2013.01); *A63B 2102/18* (2015.10)

(58) Field of Classification Search

CPC ..... A63B 71/14; A63B 71/141; A63B 71/143; A41D 19/0046; A41D 19/0048

USPC ..... 2/19, 167, 161.1, 161.6; 441/56, 57, 58

See application file for complete search history.

(56) References Cited

U.S. PATENT DOCUMENTS 1,395,914 A * 11/1921 Grundmann ..... A63B 31/08 2/20
1,748,317 A * 2/1930 Sykes ..... A63B 31/04 441/57
1,767,115 A * 6/1930 Berry ..... A63B 71/143 2/19
1,826,851 A * 10/1931 Whitley ..... A63B 71/143 2/19
1,900,395 A * 3/1933 Gitt ..... A41F 1/06 2/162
2,354,601 A * 7/1944 Latina ..... A63B 71/143 2/19
2,521,488 A * 9/1950 Smith ..... A63B 71/143 2/165
2,555,969 A * 6/1951 Holcombe ..... A63B 31/08 441/58
3,999,748 A * 12/1976 Clarke ..... A63B 43/005 2/19

(Continued)

*Primary Examiner* — Jameson D Collier
*Assistant Examiner* — Heather N Mangine

(57) ABSTRACT

The lightweight ball glove includes a back portion having a plurality of lightweight layers and a shock cord tension system between the plurality of lightweight layers. The lightweight ball glove also includes a palm portion having a plurality of lightweight layers. The outer edge of the palm portion is fixedly coupled with the outer edge of the back portion to form a lightweight glove. A web portion having a monofilament mesh is fixedly coupled between a thumb and a pointer finger of the lightweight glove. A surrounding frame made of the plurality of lightweight layers is fixedly coupled with a side and bottom portion of the monofilament mesh and a bridge is fixedly coupled with the top. Cordage is used for lacing together a top portion of each finger with an adjacent finger and the bridge to form the lightweight ball glove.

14 Claims, 7 Drawing Sheets

(56) References Cited

U.S. PATENT DOCUMENTS 4,121,824 A * 10/1978 Hirschfield ..... A63B 69/0002 2/19
4,227,263 A * 10/1980 Zidele ..... A63B 71/143 2/19
4,279,681 A * 7/1981 Klimezky ..... A63B 71/143 156/245
4,628,543 A * 12/1986 Hunt ..... A63B 71/143 2/161.1
4,665,561 A * 5/1987 Aoki ..... A63B 71/143 2/16
4,768,232 A * 9/1988 Villalobos ..... A42B 1/006 2/161.1
4,817,209 A * 4/1989 Lehmann ..... A63B 71/143 2/19
4,829,600 A * 5/1989 Courtney ..... A42B 1/006 2/161.1
4,908,880 A * 3/1990 Clevenhagen ..... A63B 71/143 2/19
4,923,418 A * 5/1990 Hoffman ..... A63B 21/065 441/57
5,079,776 A * 1/1992 Crawford ..... A63B 71/141 2/162
5,155,865 A * 10/1992 Walker ..... A63B 71/143 2/18
5,398,342 A * 3/1995 Kinnee ..... A63B 71/143 2/161.1
5,402,537 A * 4/1995 Kolada ..... A63B 71/143 2/161.1
5,425,142 A * 6/1995 Scott ..... A63B 71/143 2/160
5,542,129 A * 8/1996 Munoz ..... A42B 1/006 2/19
5,544,362 A * 8/1996 Synek ..... A63B 71/143 2/19
5,551,083 A * 9/1996 Goldsmith ..... A63B 71/143 2/161.1
5,584,133 A * 12/1996 Motooka ..... A63B 71/143 2/160
5,592,688 A * 1/1997 LaRonge ..... A63B 71/143 2/161.1
5,678,245 A * 10/1997 Rector ..... A63B 71/143 2/19
5,706,519 A * 1/1998 Cooper ..... A63B 71/143 2/16
5,907,871 A * 6/1999 Austin ..... A42B 1/006 2/181
6,182,289 B1 * 2/2001 Brown ..... A63B 71/143 2/161.1
6,212,688 B1 * 4/2001 Leslie ..... A41D 19/0041 2/160
6,286,148 B1 * 9/2001 Meyer ..... A41D 19/0034 2/161.1
6,308,331 B1 * 10/2001 Robak ..... A63B 71/081 2/161.1
6,347,402 B1 * 2/2002 Aoki ..... A63B 71/143 2/19
6,412,113 B1 * 7/2002 Guenther ..... A63B 71/143 2/19
6,460,184 B1 * 10/2002 Nishimura ..... A63B 71/143 2/19
6,487,724 B1 * 12/2002 Aoki ..... A63B 71/143 2/19
6,553,576 B1 * 4/2003 Knapp ..... A41D 19/01547 2/160
6,640,339 B1 * 11/2003 Gilligan ..... A63B 71/143 2/19
6,681,401 B1 * 1/2004 Marino ..... A63B 71/143 2/19
6,681,402 B1 * 1/2004 Bevier ..... A41D 19/01523 2/19
6,952,837 B1 * 10/2005 Aoki ..... A41D 19/01582 2/19
7,013,486 B1 * 3/2006 Sullivano ..... A63B 71/143 2/19
9,314,060 B2 * 4/2016 Giles ..... A42B 3/18
9,616,316 B2 * 4/2017 Smith ..... A63B 71/143
2003/0211905 A1 * 11/2003 Miller ..... A63B 69/0002 473/424
2005/0014580 A1 * 1/2005 Silman ..... A63B 69/0002 473/424
2005/0268366 A1 * 12/2005 Anderson ..... A63B 71/143 2/19
2008/0000010 A1 * 1/2008 Erickson ..... A41D 19/01547 2/161.6
2008/0235842 A1 * 10/2008 Patel ..... A63B 69/0002 2/19
2008/0295211 A1 * 12/2008 Lo ..... A41D 19/0068 2/16
2009/0000004 A1 * 1/2009 Rumer ..... A63B 71/143 2/19
2009/0183294 A1 * 7/2009 Lucas, Jr. ..... A41D 19/01523 2/161.1
2010/0263101 A1 * 10/2010 Magno ..... A63B 69/0002 2/19
2012/0180190 A1 * 7/2012 McNamee ..... A63B 71/143 2/158
2013/0061368 A1 * 3/2013 Filippone ..... A41D 19/0024 2/160
2013/0185838 A1 * 7/2013 Newman ..... A63B 71/143 2/19
2014/0151410 A1 * 6/2014 Craig ..... A63B 71/0045 223/78
2014/0259257 A1 * 9/2014 Hewitt ..... A63B 71/143 2/19
2015/0082504 A1 * 3/2015 Neff ..... A63B 71/143 2/19
2015/0096094 A1 * 4/2015 Elliott ..... A63B 69/0084 2/19
2015/0113829 A1 * 4/2015 Kodad ..... A43B 13/20 36/29
2016/0067587 A1 * 3/2016 Silva ..... A63B 71/143 434/247

* cited by examiner

LIGHTWEIGHT BALL GLOVE

TECHNICAL FIELD

Examples described herein relate to a lightweight ball glove often used for catching an object.

BACKGROUND

Ball gloves or mitts are used in numerous sports from kids' backyard pick-up games to adult's professional athletic events. However, it takes an amount of preparation and pre-planning to have a mitt available at an event. The planning often includes the mitt being mentioned in the invite, a bag to transport the mitt to and from the event, etc. As such, when a spur of the moment event occurs, people often will attempt to use numerous different at hand objects to act as a mitt. Such objects can include a hat, a shoe, a bare hand, a drinking cup, a paper food tray, an oven mitt, and the like. In many cases, the at-hand object is not a very practical or even a semi-useful substitute.

BRIEF DESCRIPTION OF THE DRAWINGS

The accompanying drawings, which are incorporated in and form a part of this specification, illustrate various embodiments and, together with the Description of Embodiments, serve to explain principles discussed below. The drawings referred to in this brief description should not be understood as being drawn to scale unless specifically noted.

DETAILED DESCRIPTION

Figure 1B:
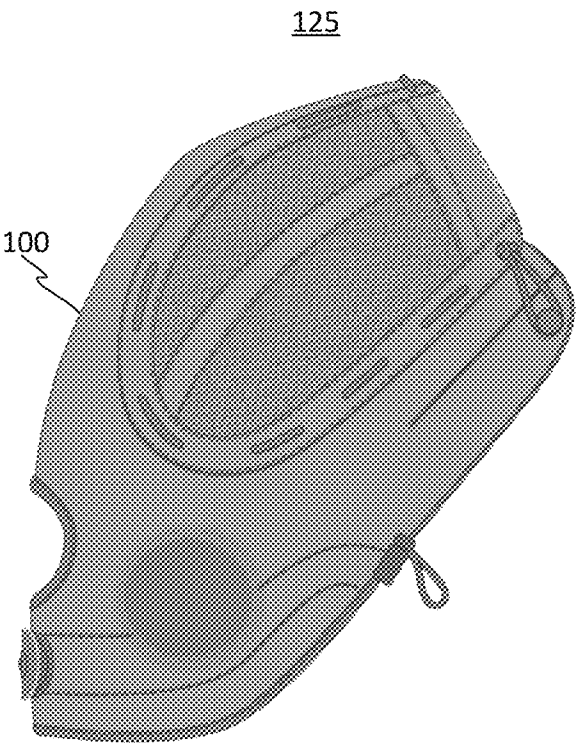
FIGS. 1A-1D are perspective views of a lightweight ball glove shown from each of a back view, a thumb view, a palm view, and a pinky side view respectively, in accordance with an embodiment.
Figure 1A:
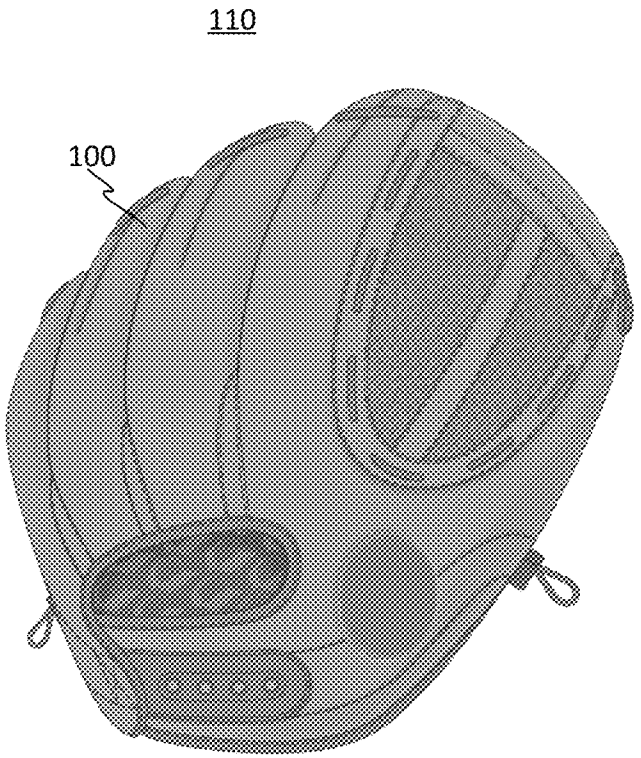
Figure 1D:
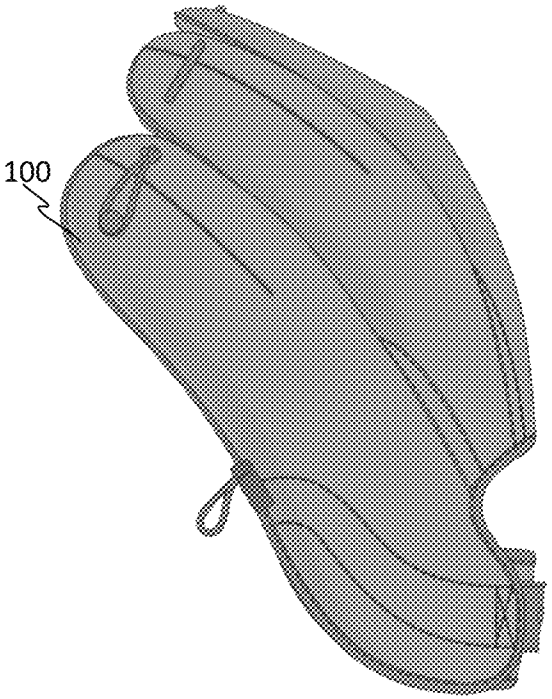
Figure 1C:
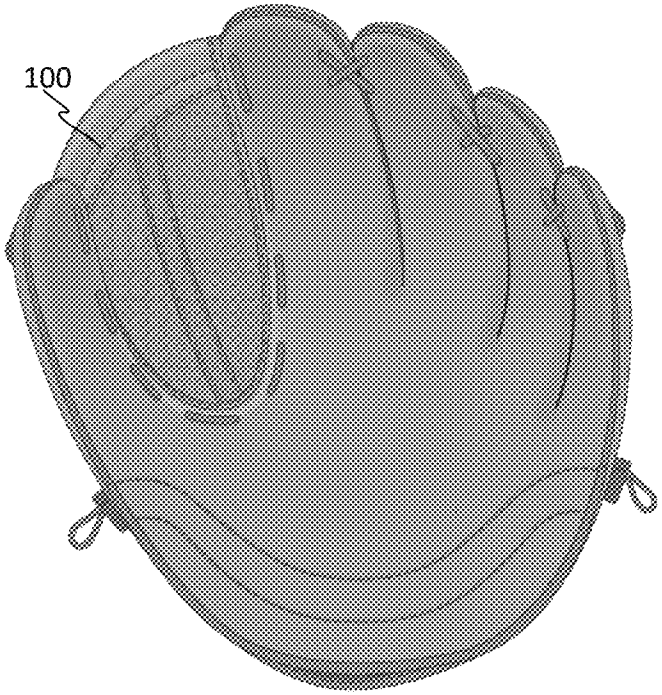

Reference will now be made in detail to embodiments of the subject matter, examples of which are illustrated in the accompanying drawings. While the subject matter discussed herein will be described in conjunction with various embodiments, it will be understood that they are not intended to limit the subject matter to these embodiments. On the contrary, the presented embodiments are intended to cover alternatives, modifications and equivalents, which may be included within the spirit and scope of the various embodiments as defined by the appended claims. Furthermore, in the Description, numerous specific details are set forth in order to provide a thorough understanding of embodiments of the present subject matter. However, embodiments may be practiced without these specific details. In other instances, well known methods, procedures, components, and circuits have not been described in detail as not to unnecessarily obscure aspects of the described embodiments.

Overview

When kids get together they often like to play games. Many times the games include some type of hitting and/or catching, such as whiffle ball, stick ball, snowball fights, and the like. One of the main aspects of a pick-up style ball game, or even a training practice, is the use of balls that are much lighter weight than a regulation baseball. For example, a major league baseball weighs about 5 ounces. In contrast a perforated, light-weight, resilient plastic ball, e.g., a whiffle ball, may be approximately the same size as a major league baseball but weigh in at approximately 20 grams.

Thus, the use of the plastic ball (or other light weight ball, rock, snowball, dirt clod, shuttle cock, or the like) can allow a game or practice to occur on much smaller fields and often without the safety gear that is necessary for an actual baseball game, e.g., batting helmet, catcher's gear, etc. Moreover, it is often helpful to train with the lightweight balls during batting practice. The reduced flight range and ballistics allow the batting practice to be performed at an increased cadence, in a smaller area, and with a significantly reduced need for safety gear as well as a significant reduction in the chance of an impact injury occurring.

However, because of the significant weight difference between the actual baseball gear and the lightweight ball, it is often difficult if not impossible to use baseball gear when playing with a lightweight ball. For example, an actual baseball bat will significantly damage a lightweight ball. Similarly, catching a lightweight ball in a baseball glove is very difficult. More often than not, the lightweight ball will simply bounce off or out of the baseball glove. That is, because the baseball glove is designed to catch a ball that is 7-8 times heavier than the lightweight ball. As such, the impact of the lightweight ball on the baseball glove is not enough to evoke the proper operational characteristics of the glove. In other words, there is almost no "feel" when a lightweight ball hits a real baseball glove.

In the following discussion, a number of different views of the parts and components are shown. Although a number of parts and components are discussed herein, it should be appreciated that different embodiments may include different parts, equivalent parts, replacement parts, different parts groupings, a combination of parts into a single part, dissemination of a single part into a plurality of parts, and the like. Moreover, although illustrative embodiments have been described in detail herein with reference to the accompanying drawings, variations to specific embodiments and details are encompassed by this disclosure. It is intended that the scope of embodiments described herein be defined by claims and their equivalents.

Operation

With reference now to FIGS. 1A-1D, a lightweight ball glove 100 is shown from each of a back view 110, a thumb view 125, a palm view 130, and a pinky side view 140 respectively, in accordance with an embodiment. In general, FIGS. 1A-1D are provided to show the ready to use lightweight ball glove 100 to provide clarity prior to the broken down, layered and exploded views provided in FIGS. 2-3 and 5. For purposes of the discussion, lightweight ball glove is lightweight in comparison to a normal baseball glove, e.g., a leather baseball glove, or the like. That is, the lightweight glove is a light duty type of glove with respect to a regular baseball glove, for example, the lightweight glove is lighter in weight and construction with respect to a regular baseball glove in a similar manner that a plastic ball is lighter in weight and construction than a normal baseball.

Figure 2:
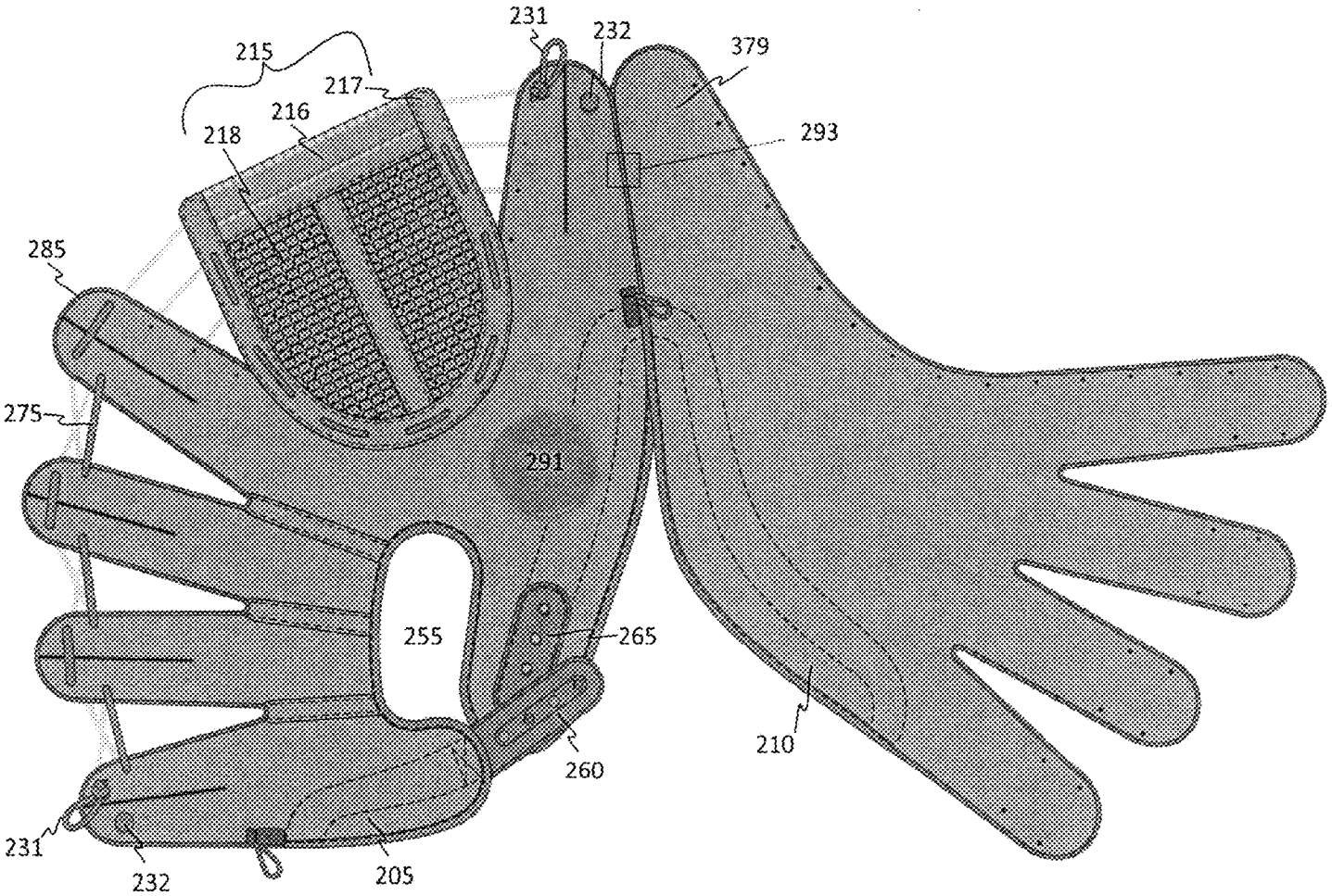
FIG. 2 is an exploded view of the lightweight ball glove and its components, in accordance with an embodiment.

With reference now to FIG. 2, an exploded view of lightweight ball glove 100 is shown in accordance with an embodiment. In general, lightweight ball glove 100 consists of a back portion 205, a palm portion 210, a web portion 215, and a cordage 275. For structure, in one embodiment, lightweight ball glove 100 will include pipe seaming 293 between back portion 205 and palm portion 210 to add structure through the finger stalls. In one embodiment, as pointed out throughout the following discussion, the materials used to manufacture the lightweight ball glove may mimic the materials and look found on a baseball hat, trucker hat, or the like.

In one embodiment, lightweight ball glove 100 also includes a logo area 291 upon which a logo may be affixed. For example, the logo may be a favorite team's logo, a friend group personalized logo, and the like. The logo in logo area 291 may be user selectable, defined at time of manufacture, dependent upon the market within which the glove is being sold, or the like. In one embodiment, the logo may be stitched, glued, silk screened or the like onto logo area 291. In another embodiment, logo area 291 may be a hook and pile tape area such that different logo devices may be affixed via the hook and pile tape connection to allow a user to change out, or switch between, logos as desired. Moreover, although a logo area 291 is shown, due to the materials utilized, there may be numerous logos, colors, images, quotes, sayings, or the like printed on different areas of the glove or the entire glove, in a similar manner such as how they can be placed on a baseball hat.

Figure 3B:
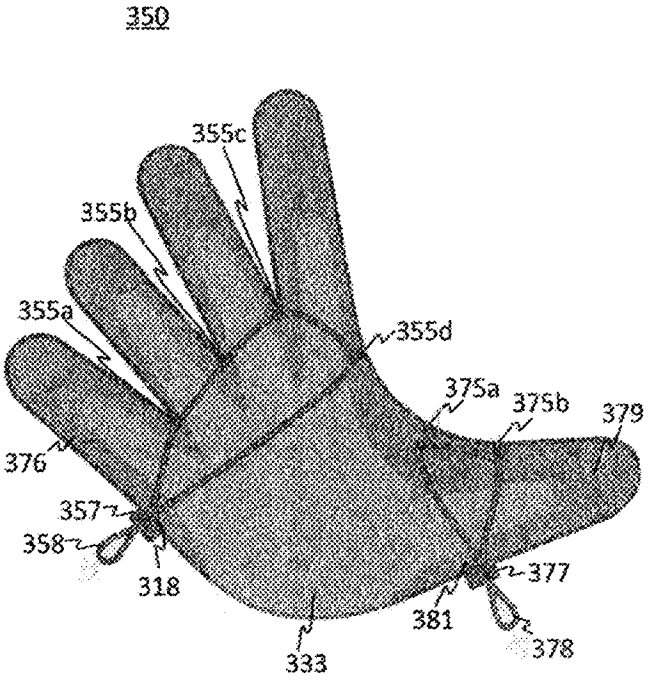
FIG. 3B is an exploded view of the layers within the lightweight ball glove, in accordance with an embodiment.
Figure 3A:
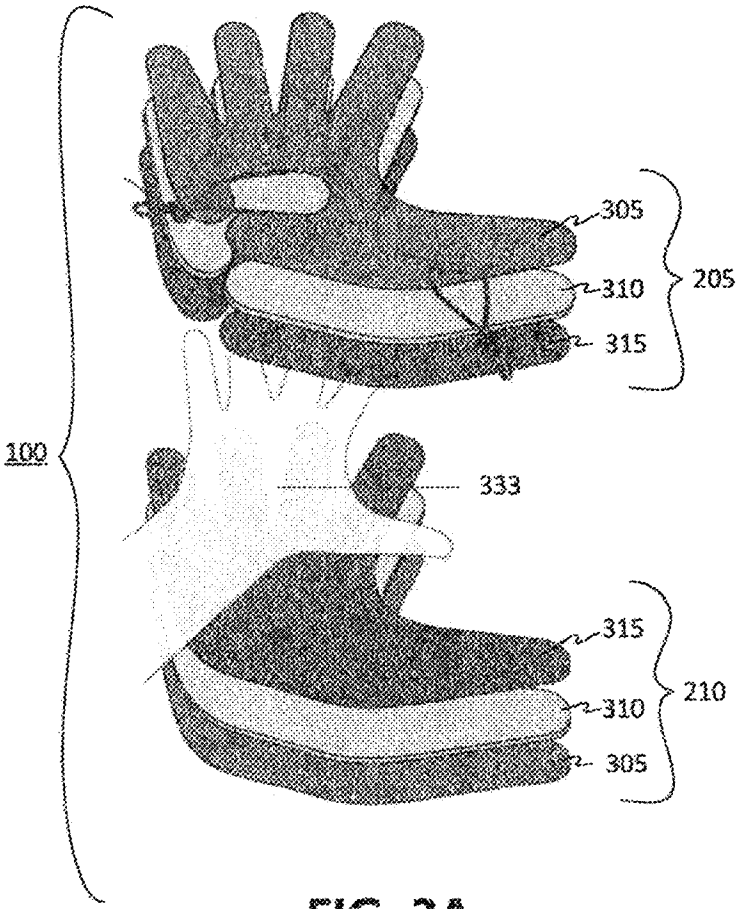
FIG. 3A is an illustration of the shock cord tension system, in accordance with an embodiment.

Referring now to FIG. 3A an exploded view of the layers within lightweight ball glove 100 is shown in accordance with an embodiment. In general, back portion 205 includes a plurality of lightweight layers. In one embodiment, the plurality of lightweight layers includes an inner lining layer 315, an outer surface layer 305, and a soft open cell open-cell foam layer 310 sandwiched between inner lining layer 315 and outer surface layer 305. In one embodiment, soft open-cell foam layer 310 is approximately 8 millimeters thick. In one embodiment, inner lining layer 315 and outer surface layer 305 are made from an elastic synthetic fiber lining layer material having elasticity. Examples of such a synthetic fiber material include LYCRA® (spandex or elastane), and the like. For example, in following along with a lightweight ball glove design that mimics a baseball hat; one embodiment utilizes open cell open-cell foam layer 310 that mimics, looks similar to, or is made from the same foam material as that found on a baseball hat. Similarly, in one embodiment, inner lining layer 315 and/or outer surface layer 305 may also mimic, looks similar to, or be made from the same material as that found about the foam on a baseball hat.

With reference now to FIG. 3B, an illustration of the shock cord tension system 350 is shown in accordance with an embodiment. In one embodiment, back portion 205 also includes shock cord tension system 350 located on a back surface of the soft epen-sell open-cell foam layer 310 sandwiched between inner lining layer 315 and outer surface layer 305 (as shown in FIG. 3A). In general, shock cord tension system 350 includes a plurality of loops 355*a-d* located about a finger area of lightweight ball glove 100. For example, the plurality of loops 355*a-d* may include one or more of a loop 355*d* located on an outside portion of a pointer finger-palm joint within the lightweight ball glove, and one or more loops 355*a-c* located at one or more finger webbing portions within lightweight ball glove 100.

Shock cord tension system 350 also includes an opening 318 on an outside portion of a pinky-palm joint. A cord 358 is routed into opening 318, through the plurality of loops 355*a-d* and back out opening 318. A cordlock 357 is used on cord 358 outside of opening 318 to provide an adjustable locking mechanism for holding tension on cord 358. In one embodiment, cord 358 is an elastic cord. However, in another embodiment, cord 358 may be a non-elastic material.

In general, when the user's hand 333 is put in lightweight ball glove 100, it rests between the back portion 205 and palm portion 210. Shock cord tension system 350 is used to allow different hand sizes to fit within lightweight ball glove 100. For example, after hand 333 is inserted into lightweight ball glove 100, a user can grasp cord 358 and pull it to tighten the fit of lightweight ball glove 100. When lightweight ball glove 100 is properly tightened, cordlock 357 is then used to keep the tension on cord 358 such that it does not come loose. When it is time to remove lightweight ball glove 100, the user can simply release cordlock 357 at which time cord 358 will loosen and shock cord tension system 350 will no longer be providing tension between lightweight ball glove 100 and the user's hand 333.

In one embodiment, shock cord tension system 350 also includes one or more loops 375*a-b* located about a web portion side of thumb side 379 within lightweight ball glove 100. In addition, a second opening 381 is formed on an outside portion of the thumb area. A second cord 378 is routed into second opening 381, through one or more loops 375*a-b* and back out of second opening 381. A second cordlock 377 is used on cord 378 outside of second opening 381 to provide a second adjustable locking mechanism for holding tension on second cord 378.

In general, when the user's hand is put in lightweight ball glove 100, it rests between the back portion 205 and the front portion 210 as shown in FIG. 3A. The second shock cord tension system is used to allow different hand sizes to fit within lightweight ball glove 100. For example, after hand 333 is inserted into lightweight ball glove 100, a user can grasp the second cord 378 and pull it to tighten the fit of lightweight ball glove 100 around the user's thumb. When lightweight ball glove 100 is properly tightened, second cordlock 377 is then used to keep the tension on second cord 378 such that it does not come loose. When it is time to remove lightweight ball glove 100, the user can simply release second cordlock 377 at which time second cord 378 will loosen and shock cord tension system 350 will no longer be providing tension between lightweight ball glove 100 and the user's thumb.

With reference again to FIG. 2, back portion 205 also includes an adjustable opening 255. In one embodiment, adjustable opening 255 consists of a wrist strap that includes a button portion 260 and a tongue portion 265. In general, the wrist strap is designed to once again mimic the sizing strap on an adjustable baseball cap.

For example, in one embodiment the wrist strap components are hard plastic. In general, on the wrist strap, button portion 260 of a snapback size adjustment system is provided on a first side of opening 255. Moreover, tongue portion 265 of the snapback size adjustment system is provided on a second side of opening 255. Similar to a hat design, tongue portion 265 has a plurality of holes therein which can be removably coupled with a plurality of buttons located on button portion 260 to provide a size adjustment capability to opening 255.

With reference still to FIG. 2 and also to FIG. 3A, palm portion 210 is also formed of the same plurality of lightweight layers as back portion 205. E.g., inner lining layer 315, soft epen-c-ell open-cell foam layer 310, and outer surface layer 305. In one embodiment, the outer edge of palm portion 210 is fixedly coupled with an outer edge of back portion 205 to form lightweight ball glove 100. In one embodiment, the outer edge of palm portion 210 is stitched to the outer edge of back portion 205 to form lightweight ball glove 100. In another embodiment, the outer edge of palm portion 210 is glued to the outer edge of back portion 205 to form lightweight ball glove 100. In yet another embodiment, the outer edge of palm portion 210 is both glued and stitched to the outer edge of back portion 205 to form lightweight ball glove 100.

With reference still to FIG. 2, a web portion 215 is fixedly coupled between thumb side 379 and a pointer finger 285 of lightweight ball glove 100. In one embodiment, web portion 215 is stitched to thumb side 379 and pointer finger 285 of lightweight ball glove 100. In another embodiment, web portion 215 is glued to thumb side 379 and pointer finger 285 of lightweight ball glove 100. In yet another embodiment, web portion 215 is both glued and stitched to thumb side 379 and pointer finger 285 of lightweight ball glove 100.

In one embodiment, web portion 215 includes a monofilament mesh 218. For example, in following along with a lightweight ball glove design that mimics a baseball hat; one embodiment utilizes monofilament mesh 218 that mimics, looks similar to, or is made from the same mesh as that found on a baseball hat. In addition, a surrounding frame 217 consisting of the plurality of lightweight layers is fixedly coupled with a side and bottom portion of monofilament mesh 218. In one embodiment, a bridge 216 is fixedly coupled with a top of monofilament mesh 218.

With reference still to FIG. 2, in one embodiment cordage 275 is used to lace together a top portion of each finger of lightweight ball glove 100 with an adjacent finger and bridge 216 to form lightweight ball glove 100. In one embodiment, cordage 275 is a lightweight material. In one embodiment, the cordage 275 is an elastic material.

Figure 4:
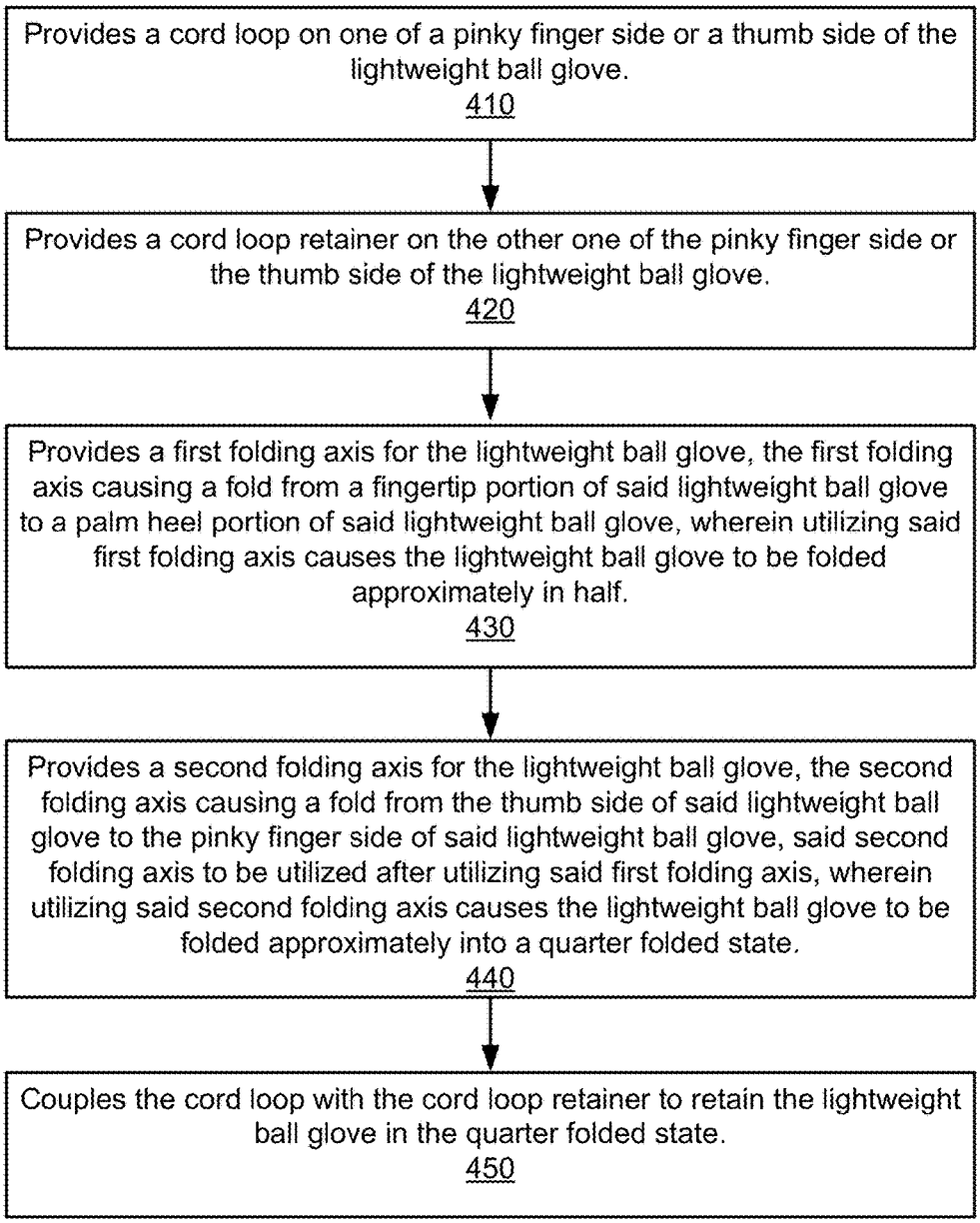
FIG. 4 is a flowchart of a method for folding the lightweight ball glove, in accordance with an embodiment.

Referring now to FIG. 4, a flowchart 400 of a method for folding lightweight ball glove 100 is shown in accordance with an embodiment. FIGS. 5A-5D are diagrams illustrating the folding steps of lightweight ball glove 100 in accordance with an embodiment. In general, when lightweight ball glove 100 is folded as described herein, it will be about a quarter of its normal length and height. In so doing, lightweight ball glove 100 will be of an appropriate size to fit into a normal sized pocket, such as a front jeans pocket, a jacket pocket or the like. Thus, making lightweight ball glove 100 easy to transport, and convenient for taking to the park, on outings, or the like.

With reference now to 410 of FIG. 4 and FIG. 2, one embodiment provides a cord loop 231 on one of a pinky finger side or a thumb side of lightweight ball glove 100.

Referring now to 420 of FIG. 4 and FIG. 2, one embodiment provides a cord loop retainer 232 on the other one of the pinky finger side or the thumb side of lightweight ball glove 100. For example, in following along with a lightweight ball glove design that mimics a baseball hat; one embodiment utilizes a hat top cap button as cord loop retainer 232. In other words, the same type of button design as usually found on the top center of a baseball hat is provided on lightweight ball glove 100 as the button around which cord loop 231 can be looped.

Figure 5A:
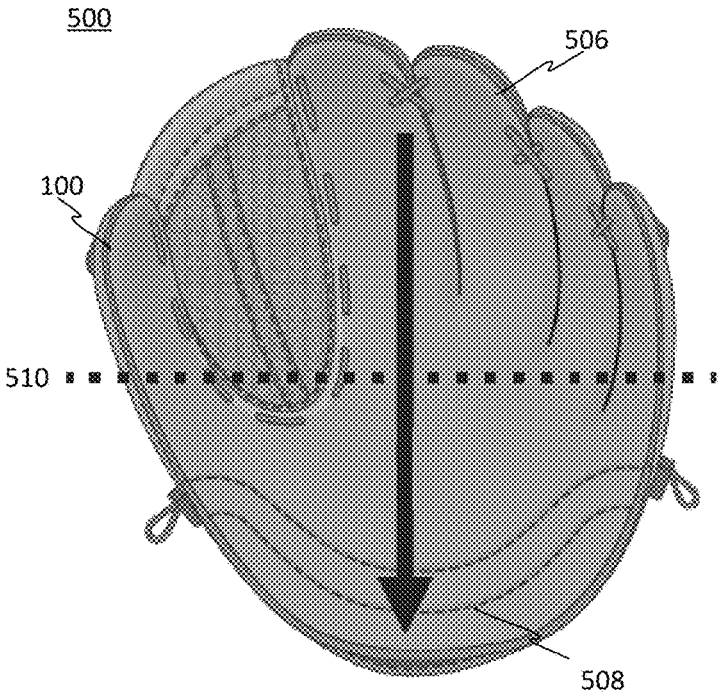
FIGS. 5A-5D are a plurality of diagrams illustrating the folding steps of the lightweight ball glove, in accordance with an embodiment.

With reference now to 430 of FIG. 4 and diagram 500 of FIG. 5A, one embodiment provides a first folding axis 510 for the lightweight ball glove, first folding axis 510 causing a fold from a fingertip portion 506 of the lightweight ball glove to a palm heel portion 508 of the lightweight ball glove, wherein utilizing first folding axis 510 causes lightweight ball glove 100 to be folded approximately in half.

Figure 5B:
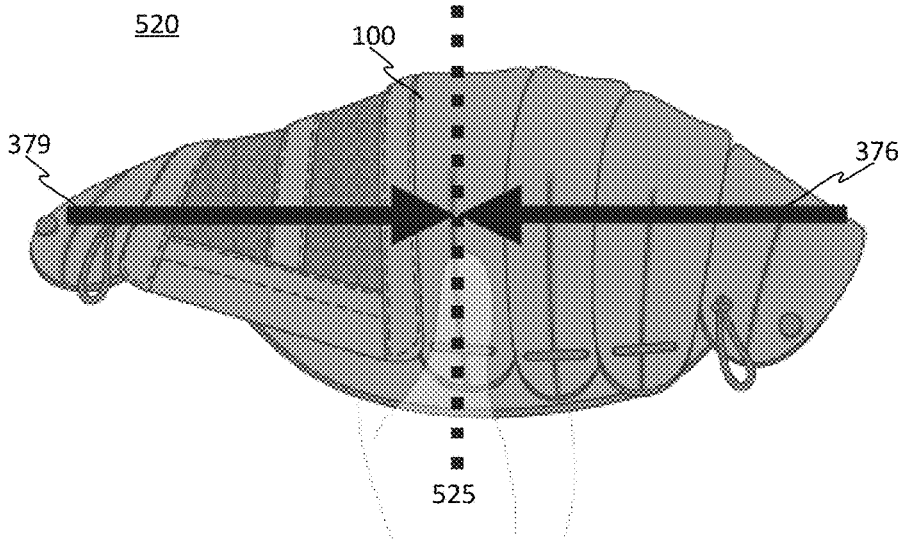
Figure 5C:
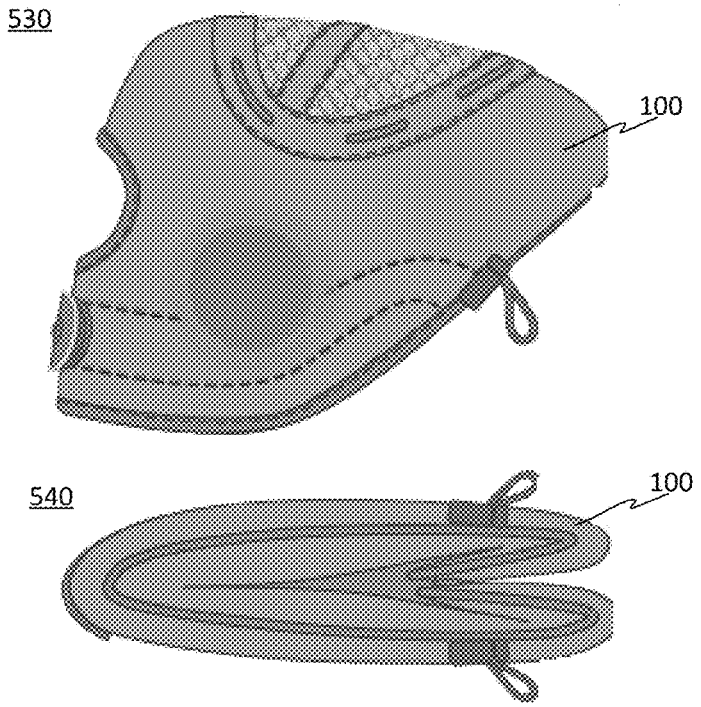

Referring now to 440 of FIG. 4 and diagram 520 of FIG. 5B, one embodiment provides a second folding axis 525 for the lightweight ball glove, second folding axis 525 causing a fold from the thumb side 379 of the lightweight ball glove to the pinky finger side 376 of the lightweight ball glove, second folding axis 525 to be utilized after the first fold has been performed utilizing first folding axis 510, wherein utilizing the second folding axis 525 causes the lightweight ball glove to be folded approximately into a quarter folded state as shown in diagrams 530 and 540 of FIG. 5C.

Figure 5D:
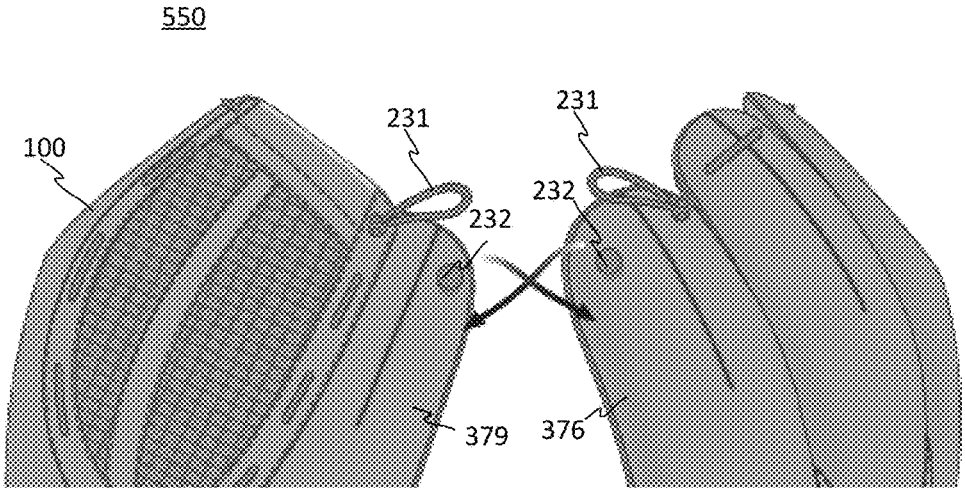

With reference now to 450 of FIG. 4 and diagram 550 FIG. 5D, one embodiment couples cord loop 231 with cord loop retainer 232 to retain the lightweight ball glove in the quarter folded state. Although lightweight ball glove 100 is well suited to only a single cord loop 231 and cord loop retainer 232; in one embodiment a second cord loop 231 is provided on the other one of pinky finger side 376 or the thumb side 379 of the lightweight ball glove opposite of the originally discussed cord loop 231. Moreover, a second cord loop retainer 232 may be provided on the other one of pinky finger side 376 or thumb side 379 of the lightweight ball glove opposite of the originally discussed cord loop retainer 232. In so doing, a user may use one or both of the cord loops and cord loop retainers to keep the lightweight ball glove in the quarter folded state.

Because of the characteristics of the lightweight ball glove discussed herein, kids and adults alike will be able to utilize the lightweight ball glove when they get together to play games that include some type of hitting and/or catching, such as whiffle ball, stick ball, snowball fights, and the like, without having to bring heavier and more expensive "real" baseball gloves. Moreover, because of its portability, stow ability, and lightweight characteristics, it will be easier to transport the lightweight ball glove in a pocket or keep one or more in a vehicle, a sports bag, or the like. As such, the lightweight ball glove will be readily available for a pick-up style ball game, or even a training practice that uses balls that are much lighter in weight than the regulation baseball.

Moreover, when there is a game intending the use of a plastic ball (tennis ball, rubber ball, or other light weight ball, rock, snowball, dirt clod, shuttle cock, or the like) the lightweight ball glove can be utilized to increase catchability. In addition, the use of lightweight ball gloves can allow a game or practice to occur on much smaller fields and often without the safety gear necessary for an actual baseball game, e.g., batting helmet, catcher's gear, etc.

Moreover, because of the similar weight characteristics between the lightweight ball glove and the lightweight ball, catching a lightweight ball in the lightweight ball glove is very similar to catching a regular baseball in a regular glove. That is, instead of the lightweight ball bouncing off or out of the lightweight ball glove, the impact of the lightweight ball on the lightweight ball glove will be enough to evoke the proper operational characteristics of the glove. In other words, there will be good "feel" when a lightweight ball hits the lightweight ball glove.

The foregoing Description is not intended to be exhaustive or to limit the embodiments to the precise form described. Instead, example embodiments in this Description have been presented in order to enable persons of skill in the art to make and use embodiments of the described subject matter. Moreover, various embodiments have been described in various combinations. However, any two or more embodiments may be combined. Although some embodiments have been described in a language specific to structural features and/or methodological acts, it is to be understood that the subject matter defined in the appended claims is not necessarily limited to the specific features or acts described above. Rather, the specific features and acts described above are disclosed by way of illustration and as example forms of implementing the claims and their equivalents.

What is claimed is:

1. A lightweight ball glove comprising: a back portion, said back portion comprising:

a first plurality of lightweight layers, said first plurality of lightweight layers comprising:

a first inner lining layer;

a first outer surface layer; and a first soft open-cell foam layer sandwiched between the first inner lining layer and the first outer surface layer; and a shock cord tension system located on a back surface of the first soft open-cell foam layer, said shock cord tension system comprising:

a first plurality of loops located about a finger area of said lightweight ball glove, said first plurality of loops comprising:

a loop located on an outside portion of a pointer finger-palm joint of said lightweight ball glove; and one or more loops located at another finger-palm joint of said lightweight ball glove;

an opening on an outside portion of a pinky-palm joint of said lightweight ball glove;

a cord routed into said opening, through said plurality of loops and back out said opening; and a cordlock about said cord outside of said opening to provide an adjustable locking mechanism for holding tension on said cord;

a palm portion, said palm portion comprising a second plurality of lightweight layers, an outer edge of said palm portion fixedly coupled with an outer edge of said back portion to form the lightweight ball glove;

a web portion, said web portion fixedly coupled between a thumb and a pointer finger of said lightweight ball glove, said web portion comprising:

a mesh formed from monofilament yarns;

a surrounding frame fixedly coupled with a side and bottom portion of said mesh, said surrounding frame comprising said first plurality of lightweight layers; and a bridge fixedly coupled with a top of said mesh; and a cordage for lacing together a top portion of said pointer finger, a top portion of said thumb of said lightweight ball glove, and said bridge to form said lightweight ball glove.

2. The lightweight ball glove of claim 1 wherein said first soft open-cell foam layer is approximately 8 millimeters thick.

3. The lightweight ball glove of claim 1 wherein said outer edge of said palm portion is stitched with the outer edge of said back portion to form the lightweight ball glove.

4. The lightweight ball glove of claim 1 wherein said outer edge of said palm portion is glued to the outer edge of said back portion to form the lightweight ball glove.

5. The lightweight ball glove of claim 1 wherein said second plurality of lightweight layers comprises:

a second inner lining layer;

a second outer surface layer; and a second soft open-cell foam layer sandwiched between said second inner lining layer and said second outer surface layer.

6. The lightweight ball glove of claim 5 wherein said second soft open-cell foam layer is approximately 8 millimeters thick.

7. The lightweight ball glove of claim 5 wherein said web portion is stitched to said thumb and said pointer finger of said lightweight ball glove.

8. The lightweight ball glove of claim 1 wherein said web portion is glued to said thumb and said pointer finger of said lightweight ball glove.

9. The lightweight ball glove of claim 1 further comprising:

an adjustable opening in said back portion, said adjustable opening comprising:

a wrist strap, said wrist strap comprising:

a button portion of a snapback size adjustment system on a first side of said adjustable opening; and a tongue portion of the snapback size adjustment system on a second side of said adjustable opening, said tongue portion having a plurality of holes therein for removably coupling with said button portion to provide a size adjustment capability to said adjustable opening.

10. The lightweight ball glove of claim 1 wherein said cord is an elastic cord.

11. The lightweight ball glove of claim 1 wherein said shock cord tension system further comprises:

a second set of one or more loops located about a web portion side of said thumb within said lightweight ball glove;

a second opening on an outside portion of said thumb of said lightweight ball glove;

a second cord routed into said second opening, through said second set of one or more loops and back out said second opening; and a second cordlock about said second cord outside of said second opening to provide a second adjustable locking mechanism for holding tension on said second cord.

12. A lightweight ball glove comprising: a back portion, said back portion comprising:

a first plurality of lightweight layers, said first plurality of lightweight layers comprising:

a first inner elastic synthetic fiber lining layer;

a first outer elastic synthetic fiber surface layer; and a first soft open-cell foam layer approximately 8 millimeters thick sandwiched between said first inner elastic synthetic fiber lining layer and said first outer elastic synthetic fiber surface layer;

a shock cord tension system located on a back surface of said first soft open-cell foam layer;

an adjustable opening in said back portion, said adjustable opening comprising:

a wrist strap, said wrist strap comprising:

a button portion of a snapback size adjustment system on a first side of said adjustable opening; and a tongue portion of the snapback size adjustment system on a second side of said adjustable opening, said tongue portion having a plurality of holes therein for removably coupling with said button portion to provide a size adjustment capability to said adjustable opening;

a palm portion, said palm portion comprising a second plurality of lightweight layers, an outer edge of said palm portion fixedly coupled with an outer edge of said back portion to form the lightweight ball glove;

a web portion, said web portion fixedly coupled between a thumb and a pointer finger of said lightweight ball glove, said web portion comprises:

a mesh formed from monofilament yarns;

a surrounding frame fixedly coupled with a side and bottom portion of said mesh, said surrounding frame comprising said first plurality of lightweight layers; and a bridge fixedly coupled with a top of said mesh; and an elastic cordage for lacing together a top portion of said pointer finger, a top portion of said thumb of said lightweight ball glove, and said bridge to form said lightweight ball glove.

13. The lightweight ball glove of claim 12 wherein said shock cord tension system comprises:

a plurality of loops located about a finger area of said lightweight ball glove, said plurality of loops comprising:

a loop located on an outside portion of a pointer finger-palm joint of said lightweight ball glove within said lightweight ball glove; and one or more loops located at another finger-palm joint of said lightweight ball glove;

an first opening on an outside portion of a pinky-palm joint of said lightweight ball glove;

a cord routed into said first opening, through said plurality of loops and back out said first opening; and a cordlock about said cord outside of said first opening to provide an adjustable locking mechanism for holding tension on said cord.

14. The lightweight ball glove of claim 13 wherein said shock cord tension system further comprises:

a second set of one or more loops located about a web portion side of said thumb within said lightweight ball glove;

a second opening on an outside portion of said thumb of said lightweight ball glove;

a second cord routed into said second opening, through said second set of one or more loops and back out said second opening; and a second cordlock about said second cord outside of said second opening to provide a second adjustable locking mechanism for holding tension on said second cord.

* * * * *